US005697669A

United States Patent [19]

Yemini

[11] Patent Number: 5,697,669

[45] Date of Patent: Dec. 16, 1997

[54] COMBINATION STOOL AND STORAGE/ TOOL BOX WITH RUBBER STOPPER RECEPTACLES AND SNAP-ON LID

[75] Inventor: Zvi Yemini, Tel Aviv, Israel

[73] Assignee: Zag Ltd., Rosh Ha'Ayin, Israel

[21] Appl. No.: 647,529

[22] Filed: May 15, 1996

Related U.S. Application Data

[63] Continuation-in-part of Ser. No. 447,861, May 24, 1995, abandoned.

[51] Int. Cl.[6] ..... A47C 7/62

[52] U.S. Cl. ..... 297/188.1; 312/235.2; 312/237; 312/235.1; 248/188.9; 16/257; 403/364

[58] Field of Search ..... 312/235.1, 235.2, 312/235.9, 235.5, 244, 902, 293.2, 237; 108/25; 297/188.1, 423.39; 248/188.9; 49/381; 16/257; 403/364, 329, 327, 326, 375

[56] References Cited

U.S. PATENT DOCUMENTS

| | | | |
|---|---|---|---|
| D. 347,527 | 6/1994 | Breen et al. | D6/349 |
| D. 355,828 | 2/1995 | Dickinson et al. | D8/71 |
| 2,990,082 | 6/1961 | Boysen | 16/257 |
| 2,990,570 | 11/1961 | Gilpatrick | 16/257 |
| 3,099,398 | 7/1963 | Croteau | 312/235.2 X |
| 3,178,761 | 4/1965 | Restiano | 16/257 |
| 3,295,714 | 1/1967 | Di Addiaro | 16/257 |
| 3,701,450 | 10/1972 | Belzberg | 248/188.9 X |
| 3,984,028 | 10/1976 | Zinnbauer | 16/257 |
| 4,366,998 | 1/1983 | Kaiser | 312/235.1 |
| 4,458,963 | 7/1984 | Keddie | 312/237 |
| 4,744,613 | 5/1988 | Brantingham et al. | 312/235.2 |
| 5,170,972 | 12/1992 | Guell | 248/188.9 |
| 5,361,456 | 11/1994 | Newby, Sr. | 16/257 |

FOREIGN PATENT DOCUMENTS

| | | | |
|---|---|---|---|
| 770868 | 11/1967 | Canada | 248/188.9 |
| 1292529 | 9/1962 | France . | |

*Primary Examiner*—Peter M. Cuomo
*Assistant Examiner*—Rodney B. White
*Attorney, Agent, or Firm*—Mark M. Friedman

[57] ABSTRACT

A device, such as a combination stool and storage/tool box adapted for use while placed on a floor. The device features a number of rubber stoppers to prevent inadvertent sliding of the device across the floor. To hold the stoppers in place, the device includes openings in the lower portion of its legs. Each of the openings accommodates one of the stoppers and is defined by a number of semi-rigid retaining members which extend inwardly toward the center of the opening. The opening and the retaining members are dimensioned so that when the stem of the stopper is forced through the opening the retaining members exert forces on the stopper tending to retain the stopper in place substantially rigidly connected to the device.

12 Claims, 3 Drawing Sheets

FIG.3A
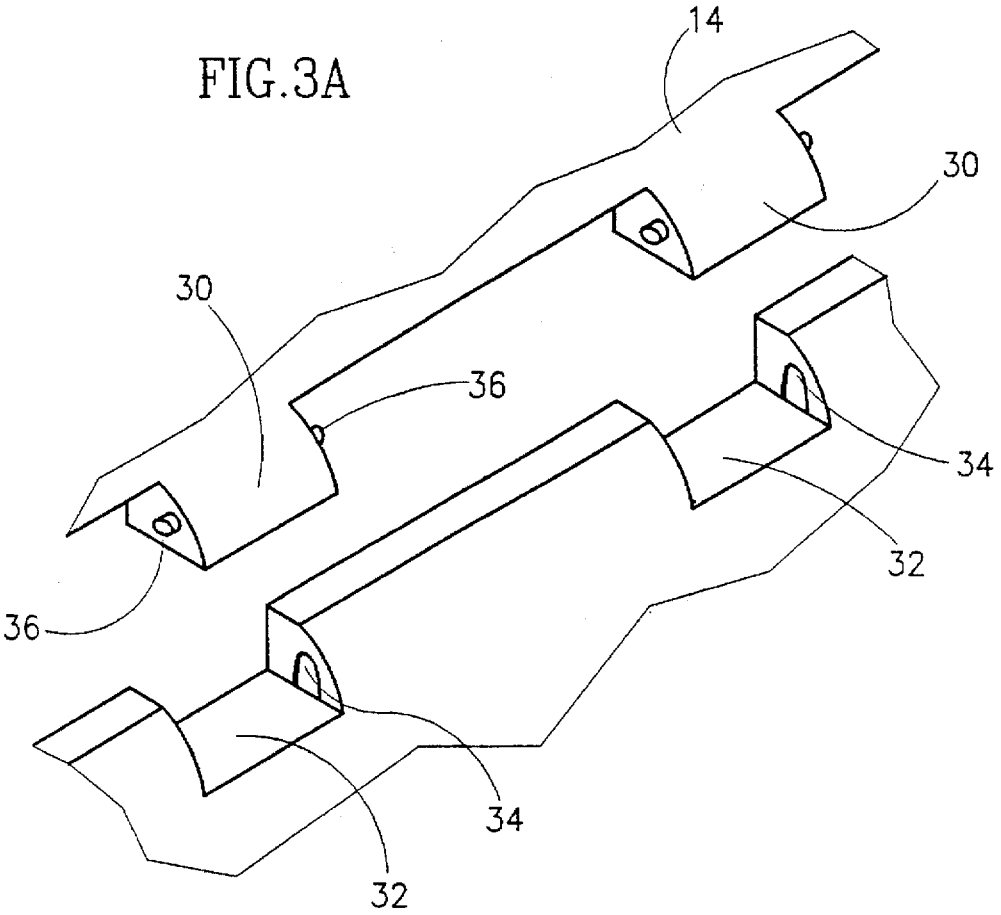
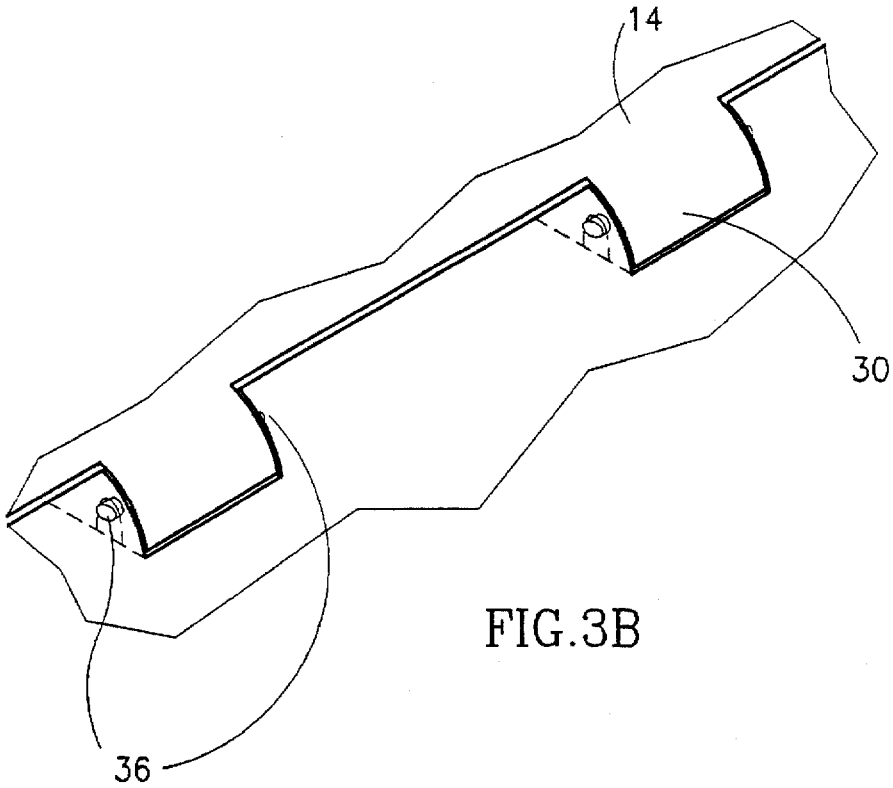
FIG.3B

COMBINATION STOOL AND STORAGE/ TOOL BOX WITH RUBBER STOPPER RECEPTACLES AND SNAP-ON LID

This is a continuation-in-part of U.S. patent application Ser. No. 08/447,861, filed May 24, 1995, now abandoned.

FIELD AND BACKGROUND OF THE INVENTION

The present invention relates to storage boxes or tool boxes and, more particularly, to storage/tool boxes which are designed to also serve as a stool for sitting and/or standing and specifically to mechanisms for connecting the lids of such boxes to the body and to mechanisms for protecting such boxes from inadvertently slipping across a floor.

A large variety of storage/tool boxes and stools are currently available. By and large, these suffer from at least two disadvantages.

First, the mechanism for connecting the box lid to the box body typically involves the use of a long pin which runs through a portion of the body and lid so as to pivotally connect the two. Such construction is relatively complicated and expensive.

Second, the portions of stools which touch the ground may be slippery so that the stool may slip in use, especially when the user steps off the stool, possibly causing injury. To overcome this difficulty, many stools are equipped with various stoppers, typically made of rubber or similar materials. Unfortunately, the connection between the stopper and the stool is usually problematic in that a bit of rough handling causes the stopper to dislodge from its place, resulting once again in direct plastic to floor contact and a resultant significant reduction in friction.

There is thus a widely recognized need for, and it would be highly advantageous to have, a mechanism for conveniently and efficiently connecting a lid to a box and a way of connecting a stopper which is not easily dislodged. In one particularly application, it would be desirable to have a combination stool and storage/tool box with a mechanism for conveniently and efficiently connecting the lid to the box and/or a way of connecting a stopper which is not easily dislodged.

SUMMARY OF THE INVENTION

According to the present invention there is provided a device adapted for use while placed on a floor, the device featuring a plurality of stoppers to prevent inadvertent sliding of the device across the floor, the device comprising a plurality of openings, each of the openings for accommodating one of the stoppers, each of the openings characterized in that the opening is defined by a plurality of semi-rigid retaining members, the members extending inwardly toward the center of the opening, the opening and the members being dimensioned so that when a portion of the stopper is forced through the opening the retaining members exert forces on the stopper tending to retain the stopper in place substantially rigidly connected to the device.

According to further features in preferred embodiments of the invention described below, the retaining members are integrally formed with the device, are substantially triangular and extend inward from a substantially circular periphery.

According to still further features in the described preferred embodiments, the device further includes two pivotally connected elements wherein one of the elements includes a pair of mounting holes and the other of the elements includes a pair of complementary protrusions so that the elements are permanently pivotally connected to each other by pressing the elements together so that the protrusions engage the mounting holes.

The present invention successfully addresses the shortcomings of the presently known configurations by providing a device, such as a combination stool and storage/tool box which is readily assembled and which is able to retain rubber stoppers so as to prevent their dislodging during use.

BRIEF DESCRIPTION OF THE DRAWINGS

The invention is herein described, by way of example only, with reference to the accompanying drawings, wherein:

FIGS. 3A and 3B are close up views showing a convenient pivotal connection between two bodies, such as the lid and the body of the device of FIG. 1, according to the present invention before and after assembly, respectively.

DESCRIPTION OF THE PREFERRED EMBODIMENTS

The present invention is of a combination stool and storage/tool box. The principles and operation of a device according to the present invention may be better understood with reference to the drawings and the accompanying description.

Figure 1:
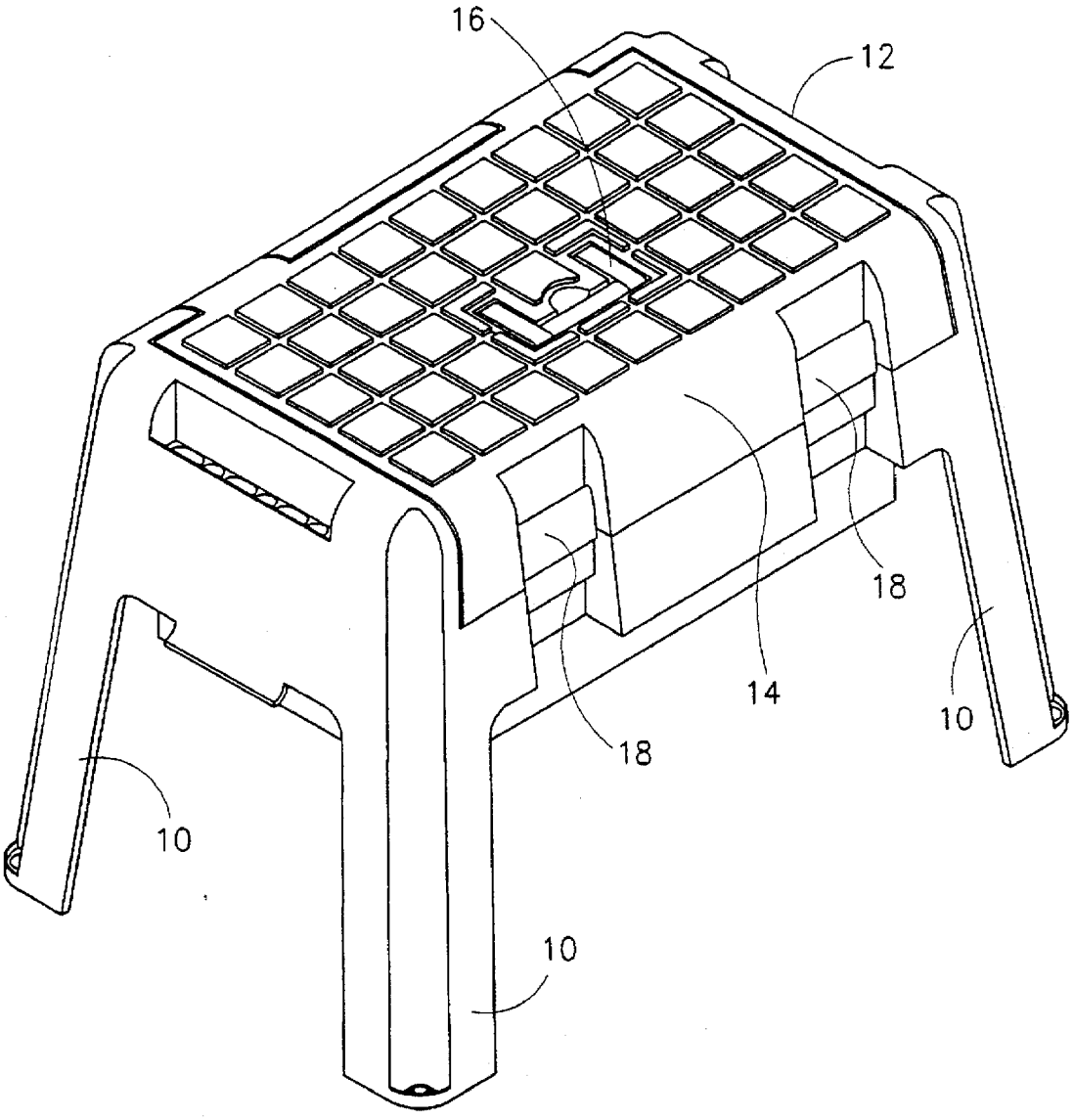
FIG. 1 is a perspective view of a combination stool and storage/tool box according to the present invention.

Referring now to the drawings, FIG. 1 illustrates a typical combination stool and storage/tool box according to the present invention. The device resembles a stool having four legs 10 and further includes a box 12 which may be used for storage of items, such as tools, and the like.

The box portion of the device features a lid 14 which is used to close the box and which doubles as the seat portion of the stool. Lid 14 preferably includes a handle 16 which is pivotally connected to lid 14 and which, when not in use, lies within a recess in lid 14 so that handle 16 is flush with the top surface of lid 14 to facilitate use of lid 14 as a sitting or standing surface. Preferably, the top surface of lid 14 is divided into a number of regions, most preferably into a chocolate bar pattern, such as shown in FIG. 1, to increase the friction between lid 14 and the user and prevent inadvertent slippage.

Lid 14 is closed at one end using any suitable latches 18 or other locking mechanisms. The other end of lid 14 is pivotally connected to the device using any suitable mechanism, preferably, the device described below and illustrated in FIGS. 3A and 3B.

Each of legs 10 of the device includes a stopper, preferably made of rubber or other high friction material, to prevent inadvertent sliding of the device across the floor. As can be seen more clearly in FIGS. 2A and 2B, near the bottom of each leg 10 is an opening 20 which serves to accommodate a stopper 22.

Each of openings 20 is characterized in that opening 20 is defined by a number of semi-rigid retaining members 24 which extend radially inwardly toward the center of opening 20. Opening 20 and retaining members 24 are dimensioned so that when a portion, typically the stem, of stopper 22 is forced through opening 20, retaining members 24 exert forces on stopper 22 which tend to retain stopper 22 substantially rigidly in place connected to leg 10 of the device. By substantially rigidly is meant that stopper 22 is held at a substantially constant orientation relative to leg 10 so that stopper 22 is not able to swivel relative to leg 10.

The rigid mounting of stopper 22 relative to leg 10 is to be contrasted with an ostensibly similar device disclosed in Canadian Patent 770,868 to Munro. The objective of the Munro device is to provide a multi-sided foot for connection to a furniture leg in such a way that the foot will be able to swivel relative to the leg, so as to allow flat secure placement of the foot on the floor, but not rotate axially relative to the leg. The Munro device relates to those combined ferrules and foot members for the legs of furniture in which the foot is connected to the ferrule in such manner as will permit the foot to swivel freely relative to the ferrule for the purpose of aligning the foot on the floor or other surface on which the furniture is supported. The object of the Munro device is to provide a multi-sided swivelling foot for a multi-sided ferrule so arranged and assembled that the sides of the foot are maintained in all positions thereof in alignment with the sides of the ferrule. To achieve the desired freedom of the foot to swivel relative to the ferrule, Munro discloses using a foot includes a bearing socket and a ferrule featuring a bearing. The bearing socket of the foot and the bearing of the ferrule are connected by a third member—a tubular rivet having a shank and a head. It is the use of this rivet which permits the desired freedom to swivel.

By contrast with the Munro device, the device of the present invention is designed to be able to resist the inadvertent slippage of the device across a floor or similar surface. The stoppers used in the present invention are installed in such a way that the stopper is directly connected (without the use of a tubular rivet) and is substantially rigidly connected, i.e., without the ability to swivel, to the leg.

Figure 2A:
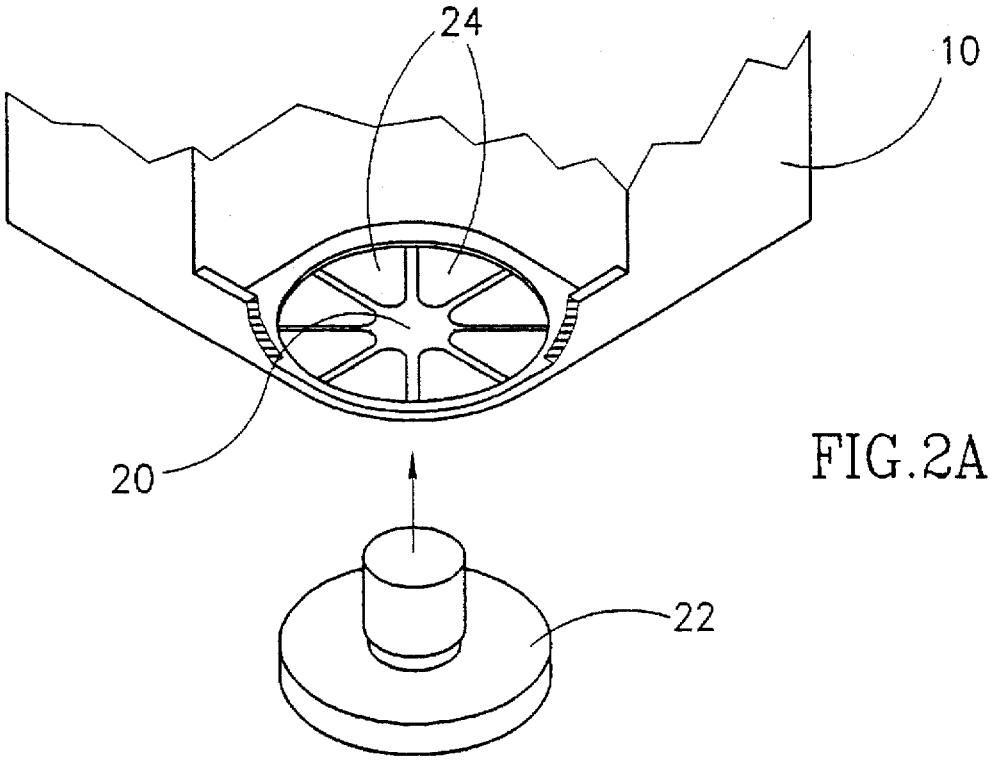
FIGS. 2A and 2B are close up views showing a mechanism for mounting a stopper, such as at the bottom of the legs of the device of FIG. 1, according to the present invention before and after the mounting of the stopper, respectively.
Figure 2B:
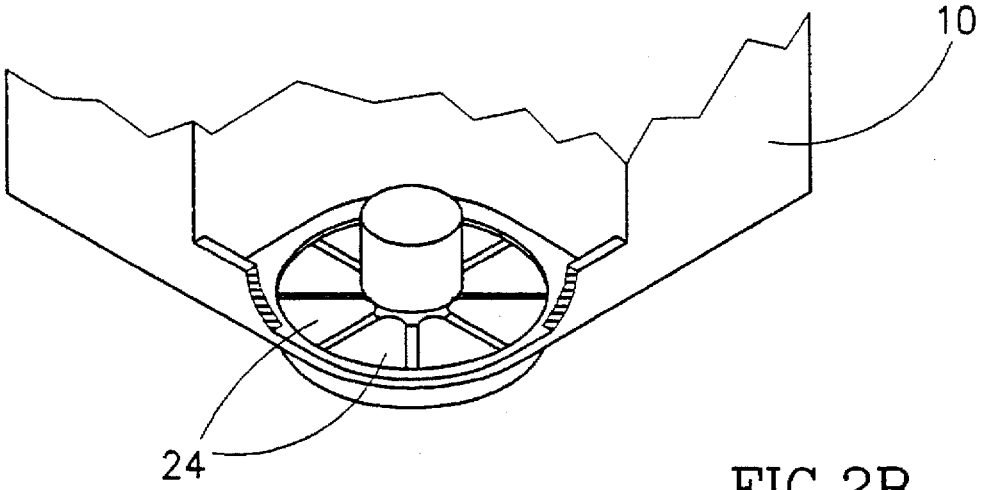

Preferably, the stem of stopper 22 is substantially cylindrical and features a portion of a first diameter at its distal end while its end near the stopper portion is of a second, and smaller, diameter. In this way, once the stem portion of stopper 22 is forced through opening 20, the inward-directed ends of retaining members 24 are able to substantially rigidly grasp stopper 24 so as to prevent its dislodging during use. Experiments conducted with a device such as illustrated in FIGS. 2A and 2B were conducted in which the device was dragged across a floor while weighted down with tools and, in some cases, while supporting the weight of a user. The tests showed that the unique design of the retaining members effectively held stopper in place and prevented its dislodging.

Preferably, retaining members 24 are substantially triangular. Preferably, retaining members 24 extend inward from a substantially circular peripheral structure.

Retaining members 24 are preferably integrally formed with the device, for example, through injection molding of the entire device. This provides for a very cost effective, yet highly efficient, construction.

Any suitable number of retaining members 24 may be used. It has been found that the use of eight such members (as shown in FIGS. 2A and 2B) leads to an effective product.

Retaining members 24 may be used in conjunction with any devices which during use are placed on a floor and where it is important to immobilize the device so as to prevent inadvertent sliding of the device across the floor. Such devices include, but are not limited to, stools of various designs and further include a combination stool and storage/tool box, such as that illustrated in FIG. 1.

Preferably, lid 14 is mounted onto the device through the use of one or more (two are shown in FIG. 1) pivotal connections. These connections may be of any suitable type. Preferably, the pivotal connections are those illustrated in FIGS. 3A and 3B. Here, lid 14 includes one or more projections 30 (two are shown in FIGS. 3A and 3B) which are dimensioned to fit within corresponding recesses 32 in the body of the device.

At each of the two side walls of each recess 32 is a mounting hole 34. Each of projections 30 features a pair of laterally extending protrusions 36 which are dimensioned to be accommodated in corresponding mounting holes 34. Protrusions 36 are preferably substantially cylindrical in shape but extend laterally outward from projection 30 to a greater extent toward lid 14 that toward the body of the device. The angled shape of the distal ends of protrusions 36 makes it more readily possible to insert protrusions into position within mounting holes 34 but makes it virtually impossible to disengage lid 14 from the body of the body of the device once the two have thus been connected.

Protrusions 36 extend outward sufficiently that, in absence of a certain amount of flexing of projection 30 and/or recess 32, it is not readily possible to insert protrusion 36 into mounting holes 34.

To assemble lid 14, lid 14 is pushed forcefully so as to cause some temporary bending or flexing of projection 30 and/or recess 32 so as to permit the insertion of protrusion 36 into mounting holes 34, aided by the downwardly angled shape of the distal ends of protrusions 36. The natural flexibility of the materials then immediately cause lid 14 to be permanently pivotally connected to the device.

While the invention has been described with respect to a limited number of embodiments, it will be appreciated that many variations, modifications and other applications of the invention may be made.

What is claimed is:

1. A device adapted for use while placed on a floor and adapted to prevent inadvertent sliding of the device across the floor, the device comprising:

(a) a plurality of openings, each of said openings being provided with a plurality of semi-rigid retaining members extending inwardly toward the center of said opening so as to substantially delimit a central aperture of diameter D; and (b) a plurality of stoppers, each of said stoppers featuring a projection for engaging within said central aperture of one of said openings, said projection having a distal portion with a lateral dimension greater than D and a proximal portion with a lateral dimension no greater than D, such that, as said projection is forced through said central aperture, said semi-rigid retaining members temporarily flex to allow passage of said distal portion and then return to a substantially unflexed state in which they bear on said distal and proximal portions so as to retain said stopper in place substantially rigidly connected to the device.

2. The device of claim 1, wherein said retaining members are substantially triangular.

3. The device of claim 1, wherein said retaining members extend inward from a substantially circular periphery.

4. The device of claim 1, wherein said retaining members are integrally formed with the device.

5. The device of claim 4, wherein said retaining members and the device are injection molded.

6. The device of claim 1, wherein said retaining members are eight in number.

7. The device of claim 1, wherein the device is a stool.

8. The device of claim 1, wherein the device is a combination stool and storage/tool box.

9. The device of claim 1, further comprising two pivotally connected elements wherein one of said elements includes a pair of mounting holes and the other of said elements includes a pair of complementary protrusions so that said elements are permanently pivotally connected to each other by pressing said elements together so that said protrusions engage said mounting holes.

10. The device of claim 9, wherein one of said elements is a body of a storage/tool box and said other element is a lid of said storage/tool box.

11. The device of claim 1, wherein said stoppers are made of rubber.

12. The device of claim 1, wherein said proximal portion of each of said stoppers is substantially cylindrical.

* * * * *